United States Patent [19]

Mattson

[11] 4,049,237

[45] Sept. 20, 1977

[54] APPARATUS FOR OBTAINING SUBSTANTIALLY EQUAL STEPLENGTH OF EACH JACK IN A GROUP OF PRESSURE FLUID OPERATED CLIMBING JACKS

[75] Inventor: Arne Mattson, Vasteras, Sweden

[73] Assignee: Paul Anderson Industrier AB, Vasteras, Sweden

[21] Appl. No.: 743,254

[22] Filed: Nov. 19, 1976

[30] Foreign Application Priority Data

Dec. 18, 1975 Sweden ..... 75143826

[51] Int. Cl.[2] ..... B66F 1/00

[52] U.S. Cl. ..... 254/106

[58] Field of Search ..... 254/89 H, 105–111

[56] References Cited

U.S. PATENT DOCUMENTS

| | | | |
|---|---|---|---|
| 2,343,993 | 3/1944 | Naylor | 254/89 R |
| 3,685,801 | 8/1972 | Ahlgren | 254/105 |
| 3,986,368 | 10/1976 | Levingston | 254/105 |

*Primary Examiner*—Robert C. Watson

*Attorney, Agent, or Firm*—Sughrue, Rothwell, Mion, Zinn and Macpeak

[57] ABSTRACT

An apparatus for obtaining substantially equal step length of each jack in a group of pressure fluid operated climbing jacks working on a common object for lifting or lowering it. The apparatus comprises at least one compensation jack associated with each climbing jack. The compensation jacks are arranged to transfer substantially the same load as the respective associated climbing jack and to be actuated when the climbing jack has carried out a full stroke without reaching the intended step length, in order thereby to effect a complementary movement of the load.

5 Claims, 1 Drawing Figure

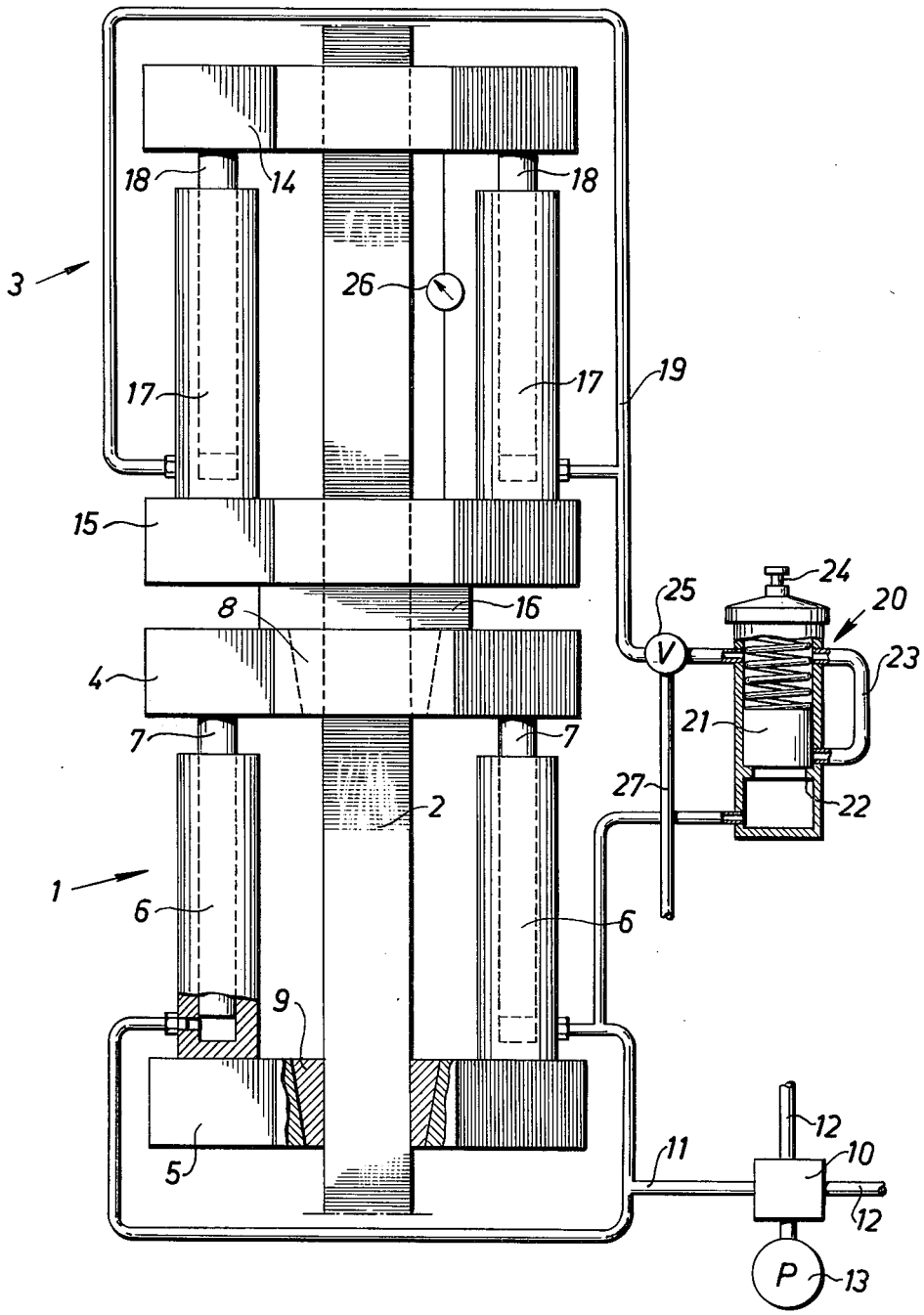
3
18
14
18
26
17
17
19
15
8
16
25
24
20
V
23
4
21
7
7
27
22
2
1
6
6
9
5
11
12
10
12
P
13

APPARATUS FOR OBTAINING SUBSTANTIALLY EQUAL STEPLENGTH OF EACH JACK IN A GROUP OF PRESSURE FLUID OPERATED CLIMBING JACKS

This invention relates to an apparatus for obtaining substantially equal step length of each jack in a group of pressure fluid operated climbing jacks working on a common object for lifting or lowering it.

For lifting heavy objects to great heights generally so-called climbing jacks, usually hydraulic ones, are used, i.e. jacks which can move in steps in one or the other direction relative to a climb rod. For this purpose, the jacks comprise two transverse yokes with means to detachably engage the climb rod which yokes can be moved towards and away from each other, respectively, by means of pressure cylinders with associated pistons provided between said yokes. The yokes may be provided either with latch members for cooperation with projections spaced apart a predetermined distance along a climb rod or with preferably wedge-shaped engaging jaws effecting a friction locking of the yokes to a smooth climb rod. With this latter type of jacks often a slight sliding occurs between the yokes and the climb rod when the load is being transferred, so that the length of the climbing step for such a jack becomes somewhat unsafe. Also other jacks, however, may require height re-adjustments, because the climb rods normally are supported on foundations of a more or less provisional nature which may be subjected to settlings.

In many cases a plurality of jacks must be used for each lifting operation because of the weight and extension of the object. A sliding movement of yoke relative to a climb rod or a settling in the foundation of a climb rod when it receives the load may result in when lifting a rigid object that the associated jack does not carry its part of the load when the lifting stroke is completed, due to the fact that the piston of the jack already has carried out a full stroke and does not reach the same height as the pistons of adjacent jacks.

The Swedish pat. specification No. 227 084 describes a system using balancing jacks in connection with climbing jacks. These balancing jacks are directly connected to each other, so that a sliding of one climbing jack is compensated for by a lowering of the balancing jacks associated with the remaining climbing jacks. The control length for these balancing jacks, thereby, is relatively limited.

These problems are also dealt with in Applicant's copending U.S. application Ser. No. 689,630, filed May 24, 1976; however application does not fully solve the problem arising in connection with sliding of the jack yokes relative to the climb rod.

A main object of the invention is to obtain a jack which by itself corrects its height position when it has fallen behind the remaining jacks, so that it always will carry its intended load. This adjustment shall take place individually for each jack.

This object is achieved according to the invention by means of an apparatus comprising at least one compensation jack associated with each climbing jack and arranged to transfer substantially the same load as the associated climbing jack and to be actuated when the climbing jack has carried out a full stroke without reaching the intended step length, in order thereby to effect a complementary movement of the load.

In one embodiment, the climbing jack is designed with a cylinder area slightly greater than that of the associated compensation jack, and the pressure cylinders of the two jacks communicate with each other via a conduit which is provided with a check valve preventing flow from the compensation jack to the climbing jack. As hereby the pressure is the same in the cylinders of both jacks the climbing jack itself will carry the entire load because it produces due to its greater area a higher lifting force at a certain pressure. The compensation jack will then be in compressed state. When, however, the pistons in the climbing jack extend at maximum before the intended lifting distance has been covered, for example because a sliding of the jack relative to the climb rod has taken place the compensation jack will expand and complete the lifting operation to the desired height. The check valve prevents the pressure fluid from being pressed back to the climbing jack in connection with the next lifting step because this would result in that the compensation obtained would get lost and be restored at each subsequent lifting step.

In an alternative embodiment, the cylinder area of the two jacks can be equal and a loaded check valve be provided in the conduit connecting the pressure cylinders of the two jacks. By means of this valve, thus, the pressure in the cylinders of the compensation jack normally is held on a somewhat lower level than in the climbing jack, so that it is the climbing jack which carries the entire load while the compensation jack is held compressed, because due to the lower pressure therein it produces a smaller force. When, however, as in the aforedescribed case the pistons in the climbing jack extend at maximum the increasing pressure difference between the climbing jack and the compensation jack will exceed the load on the check valve and thereby the compensation jack will expand and complete the lifting step to the desired level.

A third possibility of achieving the desired function is to sense mechanically or electrically when the pistons in the climbing jack extend at maximum and in response thereto to open a connection between the climbing jack and the pressure cylinder of the compensation jack.

The invention is described in greater detail in the following with reference to the embodiment of a climbing jack with associated compensation jack shown by way of example in the accompanying drawing.

Referring to the FIGURE, 1 generally designates a climbing jack cooperating with a climb rod 2, and 3 generally designates a compensation jack cooperating with the climbing jack. The climbing jack comprises an upper and a lower yoke 4 and 5, respectively, which are interconnected via hydraulic cylinders 6 and pistons 7. The yokes 4 and 5 are in known manner provided with wedge-shaped engaging jaws 8 and 9, respectively, to detachably engage the climb rod 2. See, for example, the Swedish pat. specification No. 206 345. The hydraulic cylinders are fed via a conduit 11 connected to a distribution device 10 which is coupled to an oil pump 13 and also provided with conduits 12 extending to other jacks working on the same object.

The compensation jack 3, too, comprises an upper and a lower transverse yoke 14 and 15, respectively, which however are movable freely relative to the climb rod, i.e. they do not comprise any engaging members for cooperation with said rod. The lower yoke 5 rests in the embodiment shown on the upper yoke 4 in the climbing jack 1 via an intermediate load-transferring disc 16. The yokes 14 and 15 can be moved towards and away from each other, respectively, by means of intermediate hydraulic cylinders 17 with associated pistons is maximized by the load on the associated overflow valve. It is hereby possible to adjust the maximum lifting force individually for each pair of jacks.

The invention can be varied in several respects within the scope of the claims. It can be applied, for example, to climb rods supported on foundations in which case the climbing jacks move upward and downward, respectively, along these rods, as well as to stationary jacks which raise and lower a climb rod to which the load is attached. The invention can also be applied to smooth climb rods cooperating with jacks having engaging jaws, as well as to rods with articulated supports cooperating with jacks provided with movable latch members. Both the climbing jacks and the compensation jacks can be provided with an arbitrary number of cylinders. It is not necessary, either, that the compensation jack is arranged in direct connection to the climbing jack, but the jacks may be located spaced from each other in which case, however, both the climbing jack and the compensation jack have to transfer the entire load as before. The climbing jacks, furthermore, may communicate with or be separated relative to each other.

What is claimed is:

1. In an apparatus for obtaining substantially equal step lengths in a group of pressure fluid operated climbing jacks having pressure cylinders, said climbing jacks used for lifting or lowering a common object, the improvement comprising at least one compensating jack and having a pressure cylinder, said compensation jack in a load transfer relationship with each climbing jack, means to transfer substantially the load to the associated climbing jack from the compensating jack, means to actuate said compensating jack when the climbing jack has carried out a full stroke without reaching said equal step length, wherein a complementary movement of the load is effectuated.

2. An apparatus according to claim 1, wherein the climbing jack has a greater pressure cylinder area that the pressure cylinder of the associated compensation jack, and the pressure cylinders of the climbing jack and compensation jack communicate with each other via a pressure conduit provided with a check valve preventing flow from the compensation jack to the climbing jack.

3. An apparatus according to claim 1, wherein the pressure cylinders of the climbing jack and compensation jack communicate with each other and wherein said means to actuate comprises a loaded valve, said valve permitting flow from the climbing jack to the compensation jack when a predetermined pressure difference exists between the pressure cylinders.

4. An apparatus according to claim 3, wherein said valve is spring-loaded and connected in parallel with an openable return conduit.

5. An apparatus according to claim 1, wherein a loaded overflow valve is coupled in a pressure conduit to the compensation jack and adapted to connect said pressure conduit to a return conduit when the pressure in the compensation jack reaches a predetermined adjustable value.

* * * * *